United States Patent [19]

Jelling

[11] Patent Number: 5,039,342

[45] Date of Patent: Aug. 13, 1991

[54] MODIFIED ASPHALT CEMENT COMPOSITIONS AND METHODS OF PRODUCING THE SAME

[75] Inventor: Murray Jelling, Roslyn Heights, N.Y.

[73] Assignees: Herman Mark; National Patent Development Corporation, ; part interest to each

[21] Appl. No.: 520,153

[22] Filed: May 8, 1990

Related U.S. Application Data

[63] Continuation of Ser. No. 269,889, Nov. 10, 1988, abandoned.

[51] Int. Cl.[5] ..... C08L 95/00

[52] U.S. Cl. ..... 106/273.1; 106/284.3

[58] Field of Search ..... 106/273.1, 284.3; 527/500

[56] References Cited

U.S. PATENT DOCUMENTS

| | | | |
|---|---|---|---|
| 2,545,963 | 3/1951 | Mack | 106/273.1 |
| 3,146,118 | 8/1964 | Thorpe | 106/278 |
| 3,303,151 | 2/1967 | Peters | 106/273.1 |
| 3,309,329 | 3/1967 | Schultz et al. | 525/54.5 |
| 3,491,047 | 1/1970 | Hotten | 525/54.5 |
| 3,547,850 | 12/1970 | Montgomery | 106/278 |
| 3,634,293 | 1/1972 | Bonitz | 106/278 |
| 3,821,144 | 6/1974 | Goyer et al. | 525/54.5 |
| 3,903,017 | 9/1975 | Ziegler et al. | 502/103 |
| 3,992,340 | 11/1976 | Bonitz | 106/274 |
| 4,166,752 | 9/1979 | Marzocchi et al. | 106/284.01 |
| 4,312,782 | 1/1982 | Mink et al. | 502/125 |
| 4,316,829 | 2/1982 | Roberts | 106/278 |
| 4,332,705 | 6/1982 | Uffner | 525/54.5 |
| 4,333,866 | 6/1982 | Uffner | 525/54.5 |
| 4,347,171 | 8/1982 | Uffner | 525/54.5 |
| 4,378,447 | 3/1983 | Grossi et al. | 525/54.5 |
| 4,383,081 | 5/1983 | Grossi et al. | 525/54.5 |
| 4,384,073 | 5/1983 | Grossi et al. | 525/54.5 |
| 4,384,074 | 4/1983 | Grossi et al. | 525/54.5 |
| 4,384,075 | 5/1983 | Grossi et al. | 525/54.5 |
| 4,384,099 | 5/1983 | Grossi et al. | 525/54.5 |
| 4,394,481 | 7/1983 | Grossi et al. | 525/54.5 |
| 4,394,482 | 7/1983 | Uffner et al. | 525/54.5 |
| 4,403,067 | 9/1983 | Uffner | 525/54.5 |
| 4,404,316 | 9/1983 | Marzocchi et al. | 525/54.5 |
| 4,404,316 | 9/1983 | Marzocchi et al. | 525/54.5 |
| 4,419,489 | 12/1983 | Grossi et al. | 525/54.5 |
| 4,426,419 | 1/1984 | Uffner et al. | 525/54.5 |
| 4,436,767 | 3/1984 | Grossi et al. | 525/54.5 |
| 4,436,864 | 3/1984 | Grossi et al. | 525/54.5 |
| 4,440,816 | 4/1984 | Uffner | 525/54.5 |
| 4,444,947 | 4/1984 | Harrington et al. | 525/54.5 |
| 4,454,269 | 6/1984 | Goodrich | 524/69 |
| 4,459,157 | 7/1984 | Koons | 106/278 |
| 4,507,365 | 3/1985 | Lower et al. | 525/54.5 |
| 4,518,741 | 5/1985 | Uffner et al. | 525/54.5 |
| 4,547,225 | 10/1985 | Grossi et al. | 106/284.4 |
| 4,551,178 | 11/1985 | Grossi et al. | 106/284.4 |
| 4,554,022 | 11/1985 | Grossi et al. | 106/284.4 |
| 4,569,968 | 2/1986 | Uffner et al. | 525/54.5 |
| 4,647,606 | 3/1987 | Hahn et al. | 525/54.5 |
| 4,654,385 | 3/1987 | Roberts et al. | 525/54.5 |
| 4,677,146 | 6/1987 | Senz | 525/54.5 |
| 4,745,155 | 5/1988 | Grossi et al. | 525/54.5 |
| 4,855,349 | 8/1989 | Ingle | 524/432 |

*Primary Examiner*—Nam X. Nguyen
*Assistant Examiner*—Mary C. DiNunzio
*Attorney, Agent, or Firm*—Irene J. Frangos; Dimitrios Drivas

[57] ABSTRACT

Chemical modified asphalt cements are produced by reacting bituminous materials with ethylenically unsaturated monomers.

14 Claims, No Drawings

MODIFIED ASPHALT CEMENT COMPOSITIONS AND METHODS OF PRODUCING THE SAME

This is a continuation of application Ser. No. 07/269,889 filed Nov. 10, 1988, abandoned.

BACKGROUND OF THE INVENTION

The present invention relates to asphaltic compositions, which have been chemically modified by reacting the asphalt with a monomer.

It is known that the properties of asphalt cement can be improved by adding modifiers such as polymers, fibers, carbon, sulfur, etc. to the asphalt composition. These modifications have resulted in improved physical properties of asphalt and the development of specific asphalt products for special applications. A variety of approaches have been used in modifying the asphalt cement with polymers. These approaches encompass dispersing or dissolving the polymers in the asphalt cement and grafting the polymer to the bitumen in the asphalt by reacting the polymer and asphalt in the presence of a polymerizable monomer. These approaches however, are expensive due to the high cost of the polymer material.

The present invention overcomes the high production expenses of the prior approaches by polymerizing monomers in the presence of or with the asphalt cement directly. The methods of this invention therefore result in modified asphalt compositions which have compositions and structures different from those of the prior art. These inventive modified asphalt compositions exhibit improved physical properties over conventional asphalt cement and at the same time are advantageously produced by an inexpensive production process.

SUMMARY OF THE INVENTION

This invention concerns asphalt cement compositions which are obtained by reacting ethylenically unsaturated monomers in the presence of the bituminous materials present in the asphalt.

The methods of the invention comprise reacting the asphalt directly with or in the presence of a polymerizable ethylenically unsaturated monomer. In a preferred embodiment of the invention an aliphatic monomer is used e.g. ethylene, propylene, vinyl acetate, butadiene. In other embodiments of the invention two or more monomers e.g. ethylene and vinyl acetate are reacted with the asphalt cement.

DETAILED DESCRIPTION OF THE INVENTION

Asphalt is a dark brown or black cementitious material which is comprised predominantly of bitumens. The bitumen contituents may be derived from natural sources or may be obtained as residues from petroleum refining. Asphalt and asphalt products, along with the uses, tests and specifications for asphalt materials are described in "A Brief Introduction to Asphalt and Some of Its Uses". The Asphalt Institute Manual Series No. 5 (MS-5), Eighth Edition, January 1982. This publication is hereby incorporated by reference.

According to the invention the asphalt which contains bituminous materials is subjected to elevated temperatures in order to transform it to a liquid state. Any type of asphalt can be used in the invention. The asphalt or bitumen material may be derived from either natural sources or refined petroleum residues and be of any commercially useful grade e.g. AC-5, AC-10, AC-20 depending on the desired end use of the modified asphalt compositions, e.g., road paving. The heating procedure is preferably performed in a reactor vessel such as an autoclave or in a tubular reactor. While in the reactor at an elevated temperature the bituminous material is contacted with one or more ethylenically unsaturated monomers. This is usually done in the presence of one or more catalytically active systems. In certain embodiments of the invention it may be preferred to carry out the reaction under elevated pressure.

Any polymerizable ethylenically unsaturated monomer can be used. Representative monomers are olefins, styrene, butadiene, ethylene, propylene, vinyl acetate, isoprene, acrylonitrile and chlorostyrene. In a preferred embodiment of the invention aliphatic monomers are used. After a short period of time, the reactor vessel is cooled to room temperature and the modified asphalt cement product is obtained as a dark-colored solid.

Depending on its further use, the solid modified asphalt cement product may be transformed to the liquid state and mixed with additional ingredients which may impart properties useful for specific applications.

Representative examples of the methods and products of the invention are as follows:

EXAMPLE 1

A 50 ml. test tube was charged with 25 grams of asphalt cement, grade AC-5, and 4.175 grams of distilled p-chlorostyrene. The contents were mixed and purged with nitrogen for 20 minutes at 70° C. Following this treatment, 0.033 grams of the initiator, 2,2-azobis-isobutyronitrile ("AIBN"), were added and the tube was placed in a boiling water bath for 3 hours. After the 3 hour boiling water bath treatment the tube was placed in a vacuum oven at 70° C. for 15 hours.

Following the 15 hour incubation, the reaction mixture was pumped under high vacuum (2 mm Hg) at 100° C. to remove unreacted monomer. The mixture was maintained under these conditions until the weight of the mixture did not continue to decrease noticeably. When a stable condition was reached, 0.92 grams of monomer had been removed. 3.255 grams of monomer had either polymerized or grafted to the asphalt cement or were otherwise incorporated into the asphalt cement composition. After the reaction, the p-chlorostyrene monomer comprised 11.5% by weight of the total weight of the chemically modified asphalt composition.

EXAMPLE 2

The experimental conditions in this example were the same as those followed in Example 1, except that 3.5 grams of acrylonitrile were used as a monomer, and were reacted with 25 grams of AC-5 asphalt cement and 0.014 grams AIBN.

After the reaction, the reaction mixture was subjected to vacuum pumping to remove unreacted monomer. Due to the vacuum pumping, the reaction mixture lost 1.23 grams of its total weight. 2.27 grams of acrylonitrile monomer remained in the reaction product. The monomer was either polymerized, or grafted or otherwise incorporated into the chemically modified asphalt composition. After the reaction, the acrylonitrile monomer comprised 9.8% by weight of the total weight of the chemically modified asphalt composition.

EXAMPLE 3

A 1000 ml three neck round bottom flask, equipped with a thermometer and metal mechanical stirrer, was charged with 300.6 grams AC-5 grade asphalt cement. The temperature of the flask was maintained at 84.C and purged with pure, dry nitrogen for 45 minutes. After purging, 40 grams of vinylacetate were added dropwise over 5 minutes. The reaction mixture was stirred for 30 minutes. 10 grams of vinylacetate and 0.2 grams of AIBN were mixed and then added to the reaction mixture over 2 minutes. The temperature of the reaction mixture started to rise; however, the temperature was maintained at 82°–88° C. After 60 minutes the unreacted vinylacetate monomer was distilled off under a vacuum (10–20 mm Hg) while maintaining the temperature at a level under 100° C. 38.4 grams of vinylacetate were recovered in this vacuum distillation.

The total amount of the chemically modified asphalt composition recovered after the reaction and vacuum distillation was 308.1 grams. This indicates that in the presence of the bitumen (AC-5), 7.5 grams of vinylacetate were either polymerized or grafted to the bitumen or were otherwise incorporated into the asphalt composition. After the reaction, the vinylacetate monomer comprised 2.5% of the total weight of the chemically modified asphalt.

EXAMPLE 4

100 ml. of decalin were placed in a three neck flask and 20 grams of AC-5 bitumen were dissolved in it under agitation. The flask containing the solution was then flushed at 60° C. with pure, dry nitrogen for 20 minutes while stirring.

In a second small flask 2 grams of titanium tetrachloride were dissolved in 6 grams of decalin and this flask was likewise flushed with nitrogen while shaking at 60° C. for 20 minutes. Without exposure to the atmosphere, 3 grams of tri-isobutylaluminum were added dropwise under agitation and a fine dark brown suspension of the catalytically active bimetallic organo Ti-Al complex was formed.

After shaking for 10 minutes, the catalyst suspension was added to the decalin bitumen solution. This system was thereafter maintained at 60° C. under agitation for approximately 10 minutes under strict exclusion of oxygen and moisture.

Pure, dry ethylene gas was then introduced and allowed to bubble through the system which consisted of the bitumen solution and catalyst in decalin solution. The reaction mixture was maintained at 60° C. with constant stirring. Polymerization of the ethylene set in immediately.

The solid polyethylene thickened the contents of the flask so that further stirring was impossible. At this point the rate of polymerization could be adjusted by diluting the ethylene with nitrogen or ethane. The process may be terminated when there is no more absorption of ethylene (by bubble count) or when there is excessive thickening of the system.

Following the reaction, the decalin was distilled off under vacuum. The resulting, black, sticky mass which is the chemically modified asphalt composition was weighed and found to be approximately 22.8 grams. It is thought that the final weight of the reaction product was greater than the initial weight of the asphalt reactant because of: a) the addition of homopolymerized ethylene; b) the graft of ethylene on the bitumen as polyethylene chains; and c) remnants of Ti and Al compounds from the catalyst.

The weight of the Ti and Al impurities, as determined by oxidative combustion of an aliquot, was 0.27 grams. Therefore 2.57 grams of polyethylenic material was added to the 20 grams of the original bitumen. This is about 11.4% of the total weight of the final modified asphalt cement composition.

The percentages of homopolymerized ethylene and of grafted polyethylene chains were also determined by NMR analysis. The NMR analysis indicated that the total modification in weight percent of bitumen was 12.8%; the formation of homopolymerized polyethylene in weight percent was 8.4%; and the grafting of monomer in weight percent was 4.4%.

EXAMPLE 5

The modification of the asphalt cement according to the methods of this invention alters and improves the properties of the unmodified asphalt cement. To illustrate this improvement, the modified asphalt cement compositions produced in Examples 1–4 were subjected to American Society for Testing Materials standard evaluation tests for asphalt ASTM D-2171, ASTM D-5, ASTM D-1559 and ASTM D-2398 and compared to the results of the same tests performed on AC-5 grade bitumen. The results are depicted in the following table.

TABLE 1

| | ASTM Method | AC-5 | Ex. 1 | Ex. 2 | Ex. 3 | Ex. 4 |
|---|---|---|---|---|---|---|
| Viscosity, 60° C., poises | D-2171 | 526 | 2130 | 2030 | 830 | 1990 |
| Penetration, 25° C., 100 grams, 5 sec., minimum | D-5 | 212 | 142 | 147 | 184 | 132 |
| Stability lb. | D-1559 | 920 | 1380 | 1410 | 1180 | 1280 |
| Flow, inches × 100 | D-1559 | 8.8 | 8.0 | 8.0 | 8.5 | 8.2 |
| Softening Point, °C. | D-2398 | 63 | 74 | 71 | 67 | 74 |

The polymer modifications to the asphalt using the the methods of this invention, stiffen the asphalt cement as shown by the higher viscosity values and lower penetration values. The stability of the modified products is greater, indicating improved strength. The flow properties are reduced indicating greater resistance to deformation under stress.

EXAMPLE 6

A modified asphalt product was prepared using the two monomers ethylene and propylene. The experimental conditions set forth in Example 4 were followed in this example, except that equal amounts of ethylene and propylene monomer were bubbled through the system in place of the single monomer.

NMR analysis of the resulting product shows the total modification in weight percent was 11.2%; the formation of homopolymerized polyethylene/-homopolymerized polypropylene in weight percent was 7.8%; and grafting of monomers in weight percent was 4.4%.

EXAMPLE 7

The grafting of ethylene onto a bituminous material may be performed by using a high pressure - high temperature - free radical initiated polymerization of ethylene, resulting in polyethylene grafted to asphalt. A quantity of bitumen, e.g. 400 grams AC-10 asphalt should be placed in an autoclave which also contains stirring equipment. The autoclave may be heated up to 250° C. and pressurized up to 3000 bars. The bitumen then should be heated up to about 180° C. and the viscous mass should be stirred at about 60 rpm. 200 grams purified ethylene and 0.1 grams benzoyl peroxide should then be added to the vessel and the pressure raised about 1500 bars. The reaction should start immediately. The temperature of the vessel must not be allowed to go higher than 210° C. After 10–15 minutes, the pressure should be reduced, the unreacted ethylene recovered and the autoclave cooled to room temperature. The reaction product should consist of a solid comprising AC-10 asphalt with LDPE grafted to it. Depending on the application of this product, it may be diluted with more AC-10 bitumen to bring the LDPE content to a desired percentage e.g. 5 to 10 weight percent.

EXAMPLE 8

In a related embodiment of the invention, a mixture of 160 grams of purified ethylene and 20 grams vinylacetate may be added to the autoclave. This mixture should graft onto the bitumen in the form of a copolymer of ethylene and vinylacetate ("EVA") with an estimated ethylene to vinylacetate molar content of 4 to 1. The content of this composition may be adjusted after the reaction by adding to it more AC-10, or more of any other bituminous material.

EXAMPLE 9

Polyethylene may be grafted to a bituminous material with the aid of a Ziegler Catalyst.

400 grams of bitumen AC-10 should be placed into an autoclave as described in Example 7 above. The vessel should then be heated to the melting point of the bitumen, and then flushed for 20 minutes with dry nitrogen in order to remove all traces of moisture and oxygen. At that point 2.5 grams of titaniumtetrachloride should be added and thoroughly mixed with the dry and oxygen-free liquid bitumen. After 15 minutes, 6.4 grams of tri-iso-butylaluminium should be added and 50 grams of ethylene pumped into the reactor at a pressure of 2.4 atmospheres. Formation of polyethylene should set in at once. The temperature should be raised up to 160 C and the mixing continued for about one hour. The pressure is then released, the unreacted ethylene is recycled and the product which is a graft of polyethylene to AC-10 may be recovered. The product may be diluted with more AC-10 until the desired final concentration of polyethylene is obtained.

EXAMPLE 10

The grafting of a mixture of ethylene and propylene to a bituminous system may be performed in a manner similar to that of Example 9. The autoclave should be flushed with dry nitrogen before the addition of the transition metal salt catalyst. In this example vanadium hexachloride instead of titaniumtetrachloride is preferred. A 4 to 1 mixture of propylene and ethylene should then be added at 3 atmospheres together with 2.6 grams of triethylaluminium. The grafting reaction should begin immediately and should be continued under agitation at 160° C. for about 45 minutes. The reactor may then be opened, the unreacted gases recovered and the vessel cooled to room temperature. The reaction product should consist of an elastomeric ethylene - propylene copolymer grafted to the bitumen.

EXAMPLE 11

A styrene-butadiene mixture may also be grafted onto bitumen. In this embodiment 400 grams of a bitumen e.g. AC-15 should be placed in the reactor, as described above, and heated to the liquid state. Then 5 grams of finely powdered potassium persulfate should be added together with 45 grams of styrene and 11 grams of butadiene, under a pressure of 2.5 atmospheres. 2.5 grams of finely powdered sodium bisulfite should be then added and the system kept agitated for 60 minutes at temperatures up to 160° C. At that time the autoclave should be brought to room temperature and the unreacted styrene and butadiene removed. The product which is a graft of a styrene-butadiene copolymer - SBS - onto the bitumen AC-15 may then recovered.

EXAMPLE 12

A controlled number of reactive hydroxyl groups may be grafted on a bituminous material according to this invention. For this purpose the autoclave described above should be filled with bitumen e.g. 190 grams of AC-15 bitumen, flushed with nitrogen and heated until its content is converted into a viscous liquid. At this point 32 grams of hydroxyethylmethacrylate ("Hema") should be added together with 2.2 grams of benzoylperoxide. Stirring is continued for 40 minutes at temperature of up to about 160° C. The reactor is then cooled down and the excess Hema removed. The number of grafted hydroxyl groups in the product may be determined by titration with butylithium (one OH group produces one molecule of butane which is determined by gas analysis).

In the compositions of this embodiment the hydroxyl groups may be used to increase the hydrophylicity of the bitumen in order to render it useful for special applications—e.g. emulsification. Thus there is provided a asphalt cement composition in which the dispersing and emulsifying ingredient is not admixed to, but chemically bonded to, the bituminous material.

EXAMPLE 13

In an autoclave equipped with heating and stirring systems may be placed 800 grams of bitumen AC-20. The autoclave is flushed for 30 minutes with pure, dry nitrogen at 80° C. under slow stirring. Then 100 grams of vinylacetate should be added together with 0.5 grams Azo-bisisobutyronitril and the agitation accelerated. During the polymerization reaction the temperature should be kept between 85°–90 ° C.

After 60 minutes the unreacted vinylacetate monomer should be flushed out with air, and the autoclave cooled to room temperature and opened. The reaction product should consist of polyvinylacetate and polyvinylacetate grafted to asphalt.

While the above describes the invention, it will be evident that various modifications can be made to this invention which do not depart from the scope or the spirit thereof.

I claim:

1. A modified asphalt composition consisting essentially of the product of a reaction of asphalt and an ethylenically unsaturated monomer in the presence of a coordination complex catalyst consisting of a transition metal halide in combination with a metallic trialkyl or dialkylhalide, wherein the monomer comprises from 2% to 10% by weight of the modified asphalt composition and the catalyst comprises from 0.2% to 2% by weight of the monomer content.

2. The modified asphalt composition according to claim 1, wherein the ethylenically unsaturated monomer is selected from the group consisting of ethylene, propylene, vinylacetate, acrylonitrile, butadiene and styrene.

3. The modified asphalt composition according to claim 1, wherein the transition metal is selected from the group consisting of titanium, vanadium and zirconium.

4. The modified asphalt composition according to claim 1 wherein the transition metal halide is titanium tetrachloride.

5. The modified asphalt composition according to claim 1, wherein the metal of the metallic trialkyl or dialkylhalide is aluminum.

6. The modified asphalt composition according to claim 1, wherein the alkyl is selected from the group consisting of methyl, ethyl, propyl, butyl and isobutyl.

7. The modified asphalt composition according to claim 1, wherein the dialkylhalide is dialkylchloride.

8. The modified asphalt composition according to claim 1, wherein the metallic trialkyl is aluminum triisobutyl.

9. The modified asphalt composition according to claim 1, wherein the asphalt comprises whole unfractionated bitumen.

10. A modified asphalt composition consisting essentially of the product of a reaction of asphalt and an ethylenically unsaturated monomer in the presence of a free radical-forming catalyst, wherein the monomer comprises from 2% to 10% by weight of the modified asphalt composition and the catalyst comprises from 0.2% to 2% by weight of the monomer content.

11. The modified asphalt composition according to claim 10, wherein the catalyst is an aliphatic azo compound.

12. The modified asphalt composition according to claim 11, wherein the catalyst is 2,2'-azobisisobutyronitrile.

13. The modified asphalt composition according to claim 10, wherein the ethylenically unsaturated monomer is selected from the group consisting of ethylene, propylene, vinylacetate, acrylonitrile, butadiene and styrene.

14. The modified asphalt composition according to claim 10, wherein the asphalt comprises whole unfractionated bitumen.

* * * * *